US005230172A

United States Patent [19]

Hsu

[11] Patent Number: 5,230,172

[45] Date of Patent: Jul. 27, 1993

[54] PICTURE FRAME

[76] Inventor: Junior-Julian Hsu, 3633 Palm Canyon, Northbrook, Ill. 60062

[21] Appl. No.: 889,850

[22] Filed: May 28, 1992

[51] Int. Cl.[5] ..... A47G 1/06

[52] U.S. Cl. ..... 40/152; 40/152.1; 40/661; 248/497

[58] Field of Search ..... 40/152, 152.1, 155, 40/156, 158.1, 661; 248/497

[56] References Cited

U.S. PATENT DOCUMENTS

| | | | |
|---|---|---|---|
| 2,361,479 | 10/1944 | Joffo | 40/152 X |
| 3,811,214 | 5/1974 | Tate | 40/152 |
| 4,939,858 | 7/1990 | Dailey | 40/152.1 |
| 5,018,291 | 5/1991 | Pasquale et al. | 40/642 |

FOREIGN PATENT DOCUMENTS

| | | | |
|---|---|---|---|
| 2220138 | 1/1990 | United Kingdom | 40/156 |

*Primary Examiner*—Kenneth J. Dorner
*Assistant Examiner*—Brian K. Green
*Attorney, Agent, or Firm*—Bacon & Thomas

[57] ABSTRACT

A picture frame consists of a main frame and two face members A and B and is characterized by a middle partition at each side of which an inner frame, an outer frame, a first backing frame, and a second frame are formed to evenly receive picture or photo to be put into the frame. Retaining means are provided on the inner frames at two opposite sides so that they may be firmly received by corresponding slots formed on a recess portion of the face members A and B when the face members A and B are set into the inner frame after a picture or photo is positioned onto the backing frames. Both the two sides of the picture frame are available for picture or photo that gives the picture frame a complete and beautiful appearance.

3 Claims, 4 Drawing Sheets

PICTURE FRAME

BACKGROUND OF THE INVENTION

The present invention relates to a picture frame, more particularly to a picture frame which is suitable either for standing alone vertically or horizontally or for wall mount.

Generally, conventional frames are so designed that only one side of them shows a picture or photo. Such frames, when placed on a desk, for example, usually face the one who sits behind the desk. Others who sit in front of the desk can, therefore, see the back side of the frames only and can not enjoy the lovely picture therein together with the owner at the same time. Some of these conventional picture frames need support to stand on the desk top that might be very inharmonious with surroundings.

SUMMARY OF THE INVENTION

It is the primary object of the present invention to provide a picture frame both sides of which are suitable for placing a picture and thereby gives itself a completely beautiful appearance.

Another object of the present invention is to provide a picture frame which is designed with calabash-shaped openings between its inner frame and a second backing frame so that the frame may be hung on a wall, in addition to be laid on a flat surface vertically or horizontally.

BRIEF DESCRIPTION OF THE DRAWINGS

The features and other objects of the present inventon can be better understood by referring to the following detailed description of the preferred embodiment and the accompanying drawings, wherein.

DETAILED DESCRIPTION OF THE PREFERRED EMBODIMENTS

Figure 1:
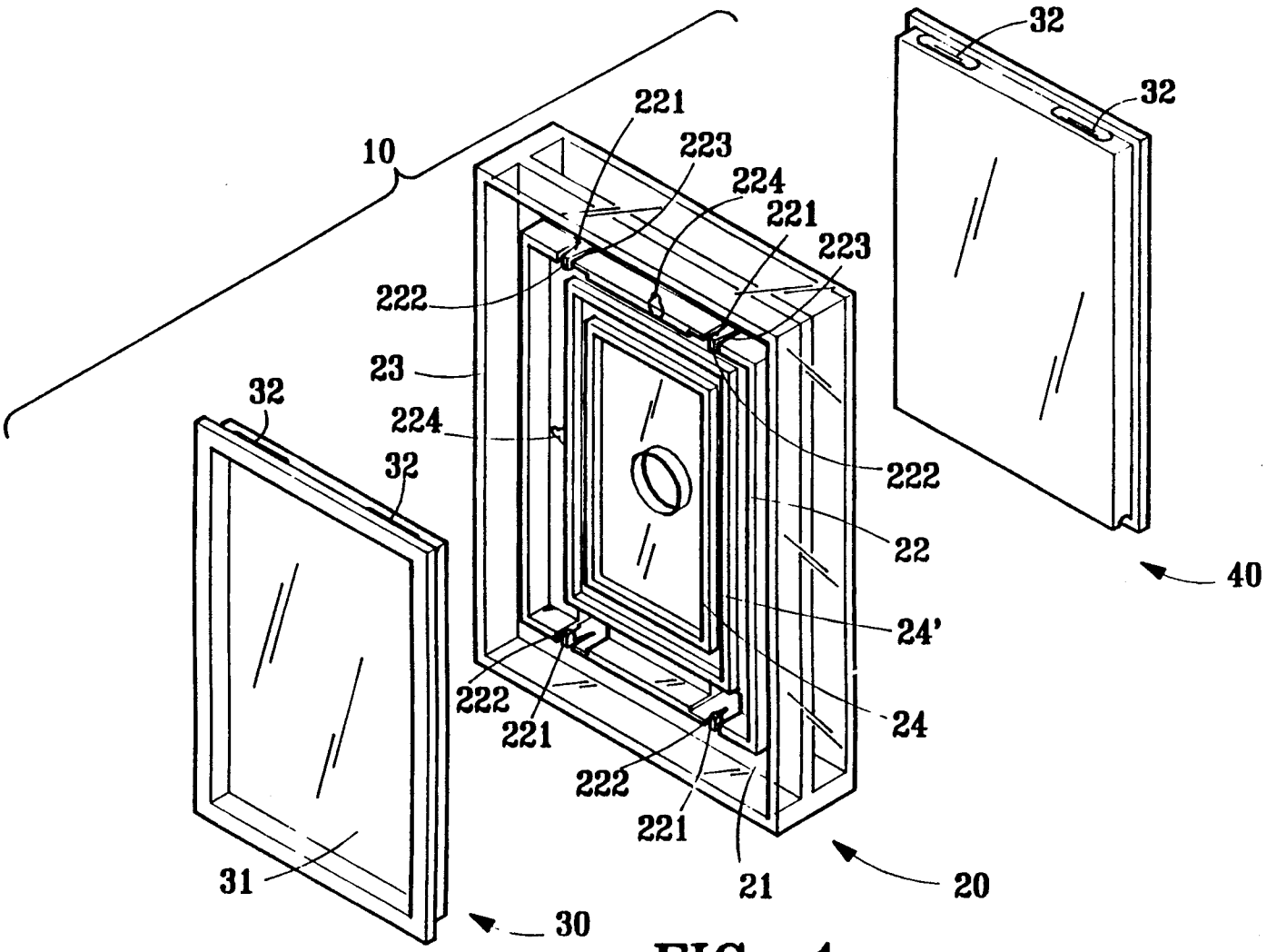
FIG. 1 is a three-dimensional analytical perspective of the present invention.
Figure 2:
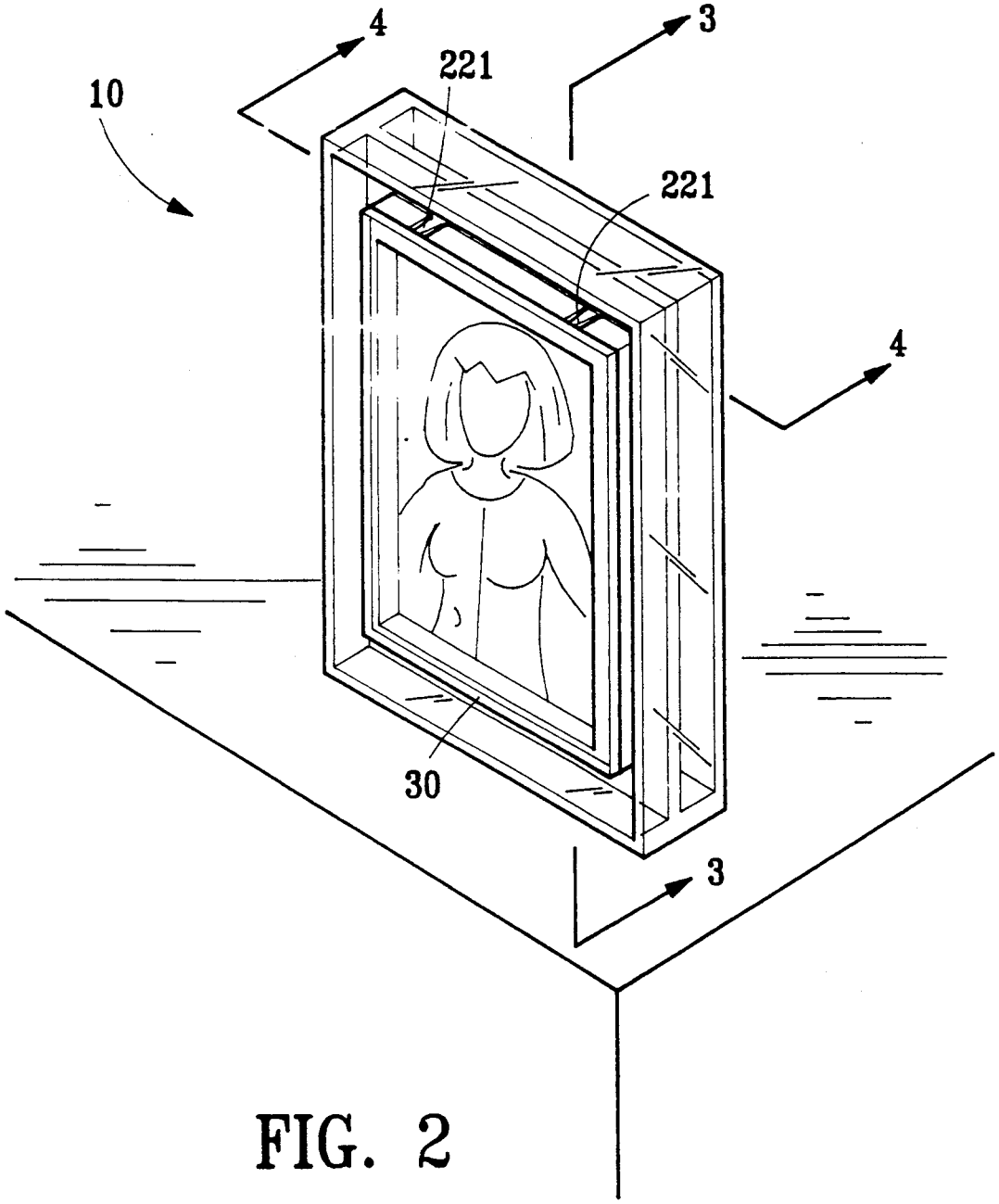
FIG. 2 shows a picture frame according to the present invention that is positioned on a flat plane.
Figure 3:
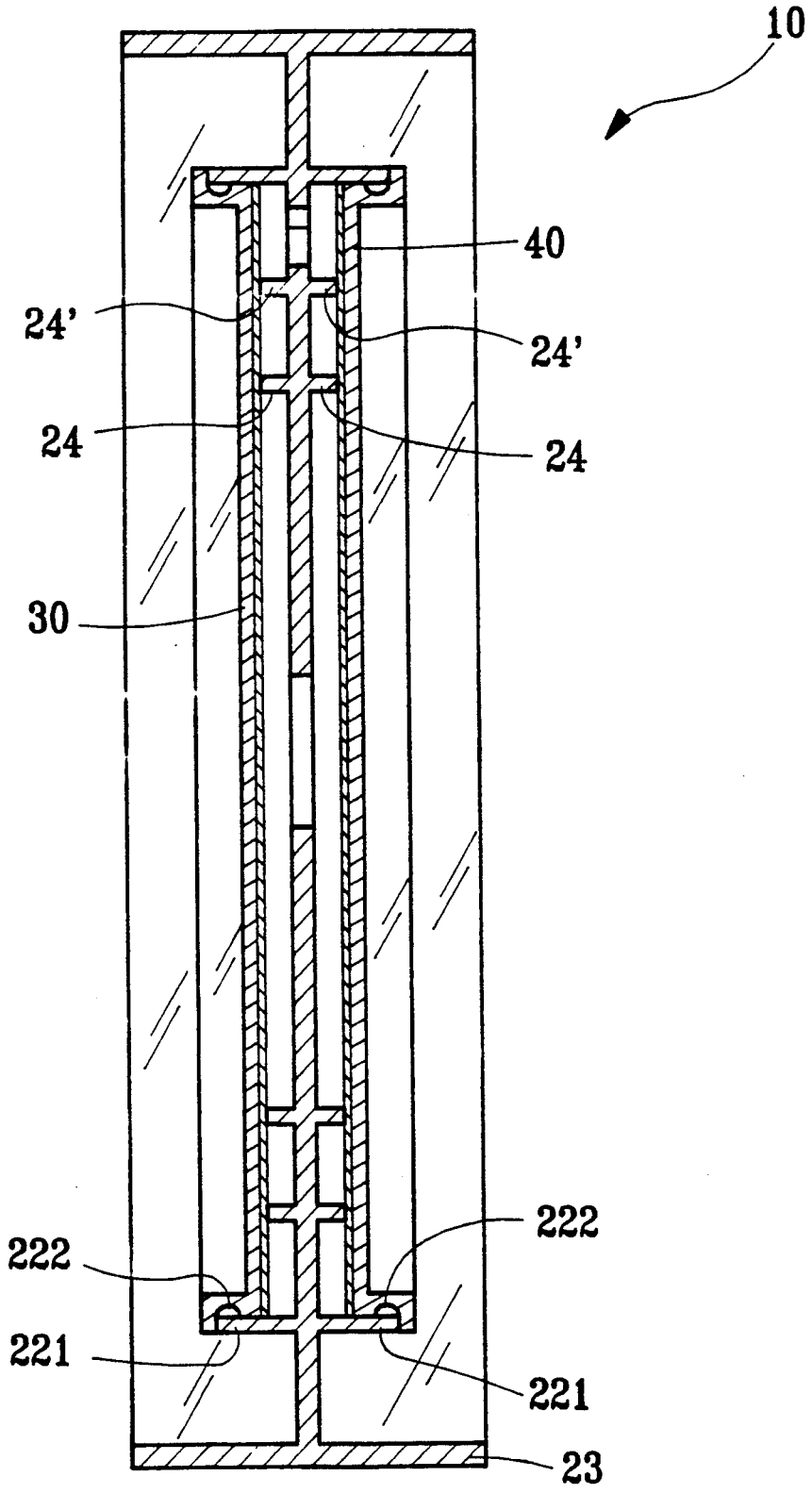
FIG. 3 is a sectional view taken on line 3—3 of FIG. 2.
Figure 4:
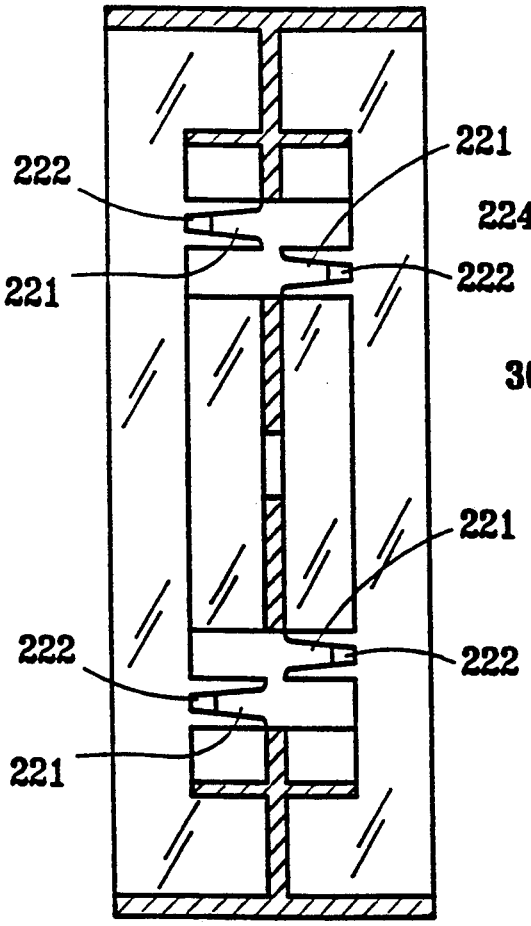
FIG. 4 is a sectional view taken on line 4—4 of FIG. 2.

Please refer to FIG. 1. A picture frame 10 according to the present invention consists of a main frame 20, a face member A 30, and a face member B 40.

The main frame 20 further includes a middle partition 21, an inner frame 22 at each side of the middle partition 21, and an outer frame 23 at each side of the middle partition 21. On any two opposite sides of the inner frames 22, retaining means 221 each with a projected head 222 are provided and are suitable for engaging with elongated receiving slots 32 formed on two corresponding opposite sides of the face member A 30 and face member B 40. Within each of the inner frames, a first backing frame 24 and a second backing frame 24' are provided on two side surfaces of the middle partition 21 to evenly back picture or photo to be put into the frame before the face member A 30 and face member B 40 are separately covered to the main frame 20. The face members A and B 30, 40 are substantially the same as the inner frames 22 in size and in shape. Both of the face members A and B 30, 40 is formed with a recess 31 the outer periphery of which is slightly smaller than the inner periphery of the inner frame 22 so that the face members A and B 30, 40 may separately loosely engage with the inner frames 22. When the face members A and B 30, 40 are set into the inner frames 22, elongated receiving slots 32 formed on two opposite ends of the recesses 31 of the face members A and B 30, 40 engage with the retaining means 221 at the projected heads 222, preventing the face members A and B 30, 40 from slipping off. Gaps 223 are reserved between the retaining means 221 and the inner frame 22 on which the retaining means 221 is provided, permitting the retaining means 221 to flexibly shift upward or downward and thereby, allowing the face members A and B 30, 40 to be easily set in or removed out of the inner frames 22.

Figure 5:
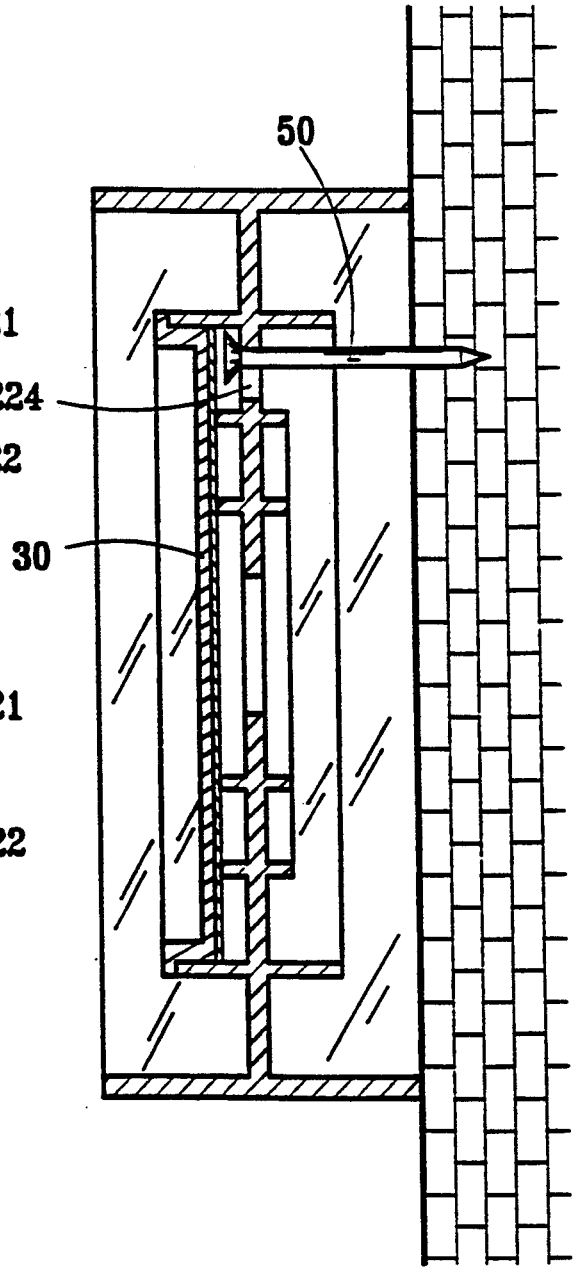
FIG. 5 is a sectional view of the picture frame according to the present invention illustrating the manner in which the frame is hung to a wall.

Please refer to FIG. 5. The picture frame according to the present invention may be hung to a wall, too, by fastening screws or the like 50 into wall surface through calabash-shaped openings 224 properly provided at spaces left between the inner frames 22 and the second backing frames 24'. To hang the picture frame 10 of the present invention, first remove the face members A and B 30, 40, then, fix the main frame 20 to the wall with fastening means 50 via the calabash-shaped openings. After the main frame 20 is fixed to the wall and a picture is set in the frame, the face member A 30 is covered to the inner frame 22.

Although the present invention has been described with a certain degree of particularity, the present disclosure has been made by way of example and changes in details of structure may be made without departing from the spirit thereof.

What is claimed is:

1. A picture frame comprising:

a main frame having a middle partition and a pair of opposite sides, an inner frame located on each of the sides of said middle partition, an outer frame located on each side of said middle partition, a first backing frame and a second backing frame provided within each of said inner frames on each of the sides of said middle partition to bear against a picture or photo put into said main frame, and a plurality of retaining means each having a projected head provided on opposite sides of said inner frames; and two face members each having a recess portion defining elongated slots on two opposite sides thereof in such a manner that each of said elongated slots on said recess portion of said face members is adapted to engage one corresponding retaining means provided on said inner frames so as to be held thereto by the engagement of said projected head of said retaining means when said face members are set into said inner frames.

2. A picture frame as claimed in claim 1, wherein said inner frame and said retaining means define gaps therebetween so that said retaining means are allowed to flexibly shift upward and downward.

3. A picture frame as claimed in claim 1, further comprising openings in the middle partition between said inner frame and said second backing frame at positions suitable for hanging said picture frame onto a wall surface by removing said face members, putting fastening means through at least one of said openings and pinning the main frame to a wall surface and then placing said face member back into said inner frame.

* * * * *